United States Patent [19]

Kuramochi

[11] 4,060,044

[45] Nov. 29, 1977

[54] TOY SEWING MACHINE

[76] Inventor: Shigeaki Kuramochi, 24-17, Koishikawa 5-Chome, Bunkyo, Tokyo, Japan

[21] Appl. No.: 656,640

[22] Filed: Feb. 9, 1976

[51] Int. Cl.[2] ..... D05B 3/02

[52] U.S. Cl. ..... 112/158 R

[58] Field of Search ..... 112/158 A, 158 R, 158 D, 112/158 E, 158 F

[56] References Cited

U.S. PATENT DOCUMENTS

| | | | |
|---|---|---|---|
| 591,634 | 10/1897 | Parkes | 112/158 R |
| 2,971,482 | 2/1961 | Koike | 112/158 A |
| 3,005,427 | 10/1961 | Engel | 112/158 R |
| 3,433,189 | 3/1969 | Weisz | 112/158 R |
| 3,699,910 | 10/1972 | Urciola et al. | 112/158 A |

*Primary Examiner*—Werner H. Schroeder
*Assistant Examiner*—Peter Nerbun
*Attorney, Agent, or Firm*—James E. Nilles

[57] ABSTRACT

A toy sewing machine capable of sewing in zig-zag patterns comprising cam body having plural cam faces, a vertically movable pin arranged to engage with any one of the cam faces of the cam body, and means for connecting said pin with a needle holding rod. Said means comprises a freely rotatable lever of "L" shape urged in one direction by a torsion bar spring, one end of said lever having the pin penetrated therethrough, and a link pivotally attached to the other end of said lever.

1 Claim, 20 Drawing Figures

TOY SEWING MACHINE

The present invention relates to a toy sewing machine capable of sewing in zig-zag patterns by using simple cams as well as sewing in straight line.

A primary object of the present invention is to provide a toy sewing machine wherein a needle holding rod is connected through a link with an end of a lever of "L" shape and a pin penetrated through the other end of the lever of "L" shape to vertically move is faced to contact with the periphery of any of cams of a cam body so that when the pin is moved in the upper or lower direction so as to engage with the periphery of one of the cams the movement of the lever of "L" shape is varied and transmitted to the needle holding rod to enable a variety of stitches of zig-zag patterns to be attained.

Another object of the present invention is to provide a toy sewing machine wherein an arm piece secured to a rod vertically extending through the "L" shaped lever is engaged with a rod horizontally extending from thread holding pieces interlocked with a lower rod so that the movement of the "L" shaped lever which is varied by the cam body is transmitted to the thread holding pieces to allow the needle holding rod and the thread holding pieces to be synchronized with each other in sewing of zig-zag patterns.

These and other objects as well as merits of the present invention will be clearly understood from the following detailed description with reference to the accompanying drawings, in which.

FIGS. *7a, 7b, 7c, 7d, 7e, 7a', 7b', 7c', 7d', 7e' 7b'', 7c'', 7d''* and *7e''* show the relation between the positions of a dial and cams and a variety of stitches to be attained in respective cases.

Figure 5:
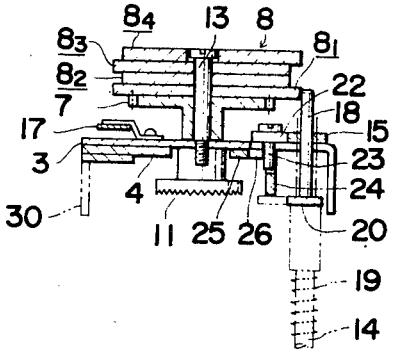
FIG. 5 is a sectioned side view of cams and a vertically movable pin.

There is mounted on a table 1 a frame 2 of box shape from the inner wall of which is projected a horizontal fixing plate 3 onto whose underside is overlapped a sliding plate 4 and plural guiding pins 5 projected from the sliding plate 4 are respectively engaged with plural guiding slits 6 provided in the horizontal fixing plate 3. As shown in FIG. 5, on a cam shaft 13 by which a gear 7 is rotatably supported on the horizontal fixing plate 3 is also rotatably supported a cam body 8 having cam faces at the outer circumference thereof. The cam body 8 comprises overlapping four cams $8_1$, $8_2$, $8_3$ and $8_4$, each of which has a different cam face, with one another in the vertical direction, but may be formed as an integral member. These cams $8_1$, $8_2$, $8_3$ and $8_4$ are formed to have convex and concave portions at the outer circumferences, respectively, as shown in FIGS. *7b'', 7c'', 7d''* and *7e''*.

Figure 2:
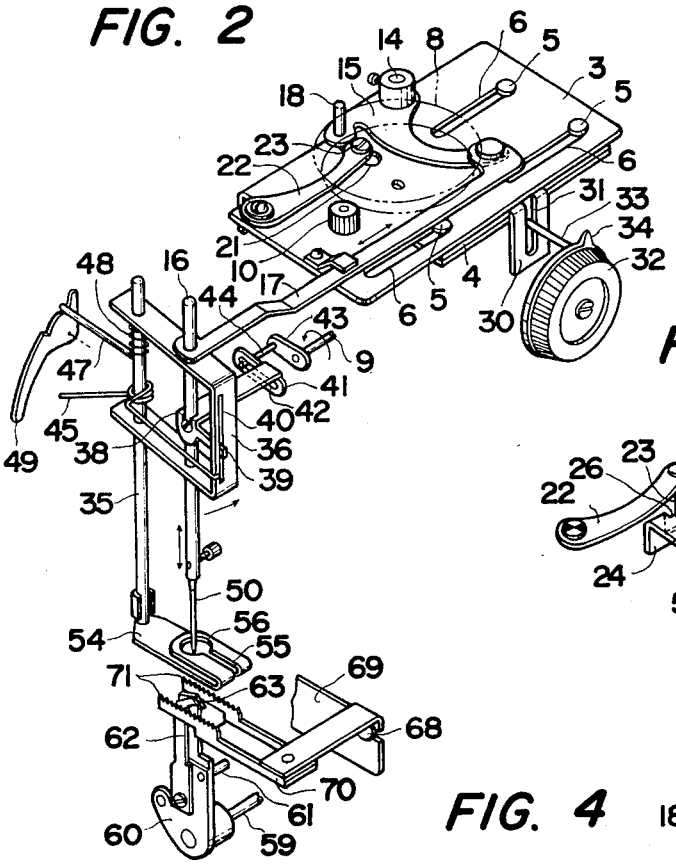
FIG. 2 is a perspective view showing the mechanism through which a needle is rendered operative.
Figure 4:
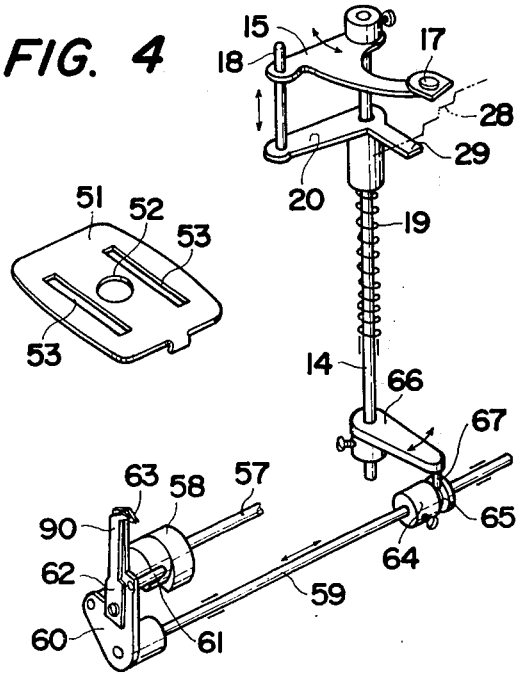
FIG. 4 is a perspective view showing the mechanism through which thread holding pieces are rendered operative.
Figure 6:
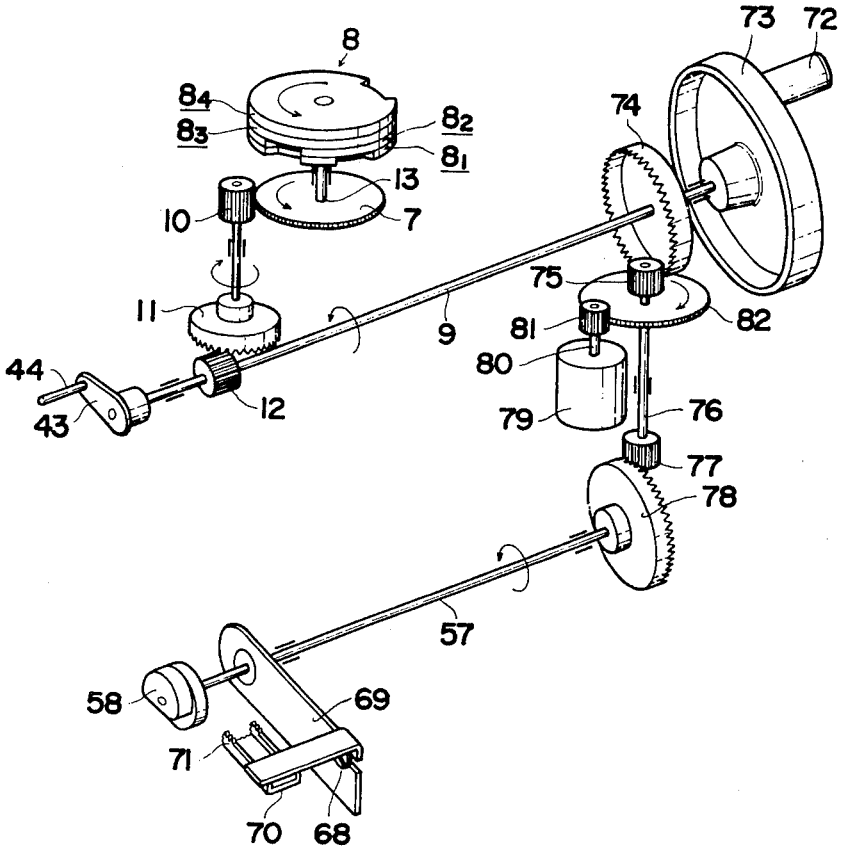
FIG. 6 is a perspective view showing a driving mechanism.

The gear 7 is arranged, as shown in FIG. 6, to associate through interlocking gears 10 and 11 and 12 below the horizontal fixing plate 3 with a rod 9 which is horizontally supported by the frame 2 and rotated so as to render a needle operative. As shown in FIG. 4, to a vertical rod 14 freely rotatably projected through the fixing plate 3 is secured the base portion of a lever 15 of "L" shape to one end of which is pivotally connected a link 17 connected to a needle holding rod 16 and to the other end of which is pivotally connected a vertically movable pin 18, said pin 18 being secured to a piece 20 which is supported by the vertical rod 14 penetrated through the "L" shaped lever 15 with the fixing plate 3 located therebetween and urged upwards by a coil spring 19. The vertically movable pin 18 is inserted, as shown in FIG. 2, through a slit 21 which is provided in the fixing plate 3 in such a direction that the pin 18 can move to contact with and disconnect from the periphery of the cam body 8, and in this slit 21 is fitted a pin 23 attached to one end of an arm piece 22, the other end of which is pivoted to the horizontal fixing plate 3. The end of the arm piece 22 having the pin 23 attached is inwardly urged by the outer circumference of the other end of the "L" shaped lever 15 to which the pin 18 is pivotally connected.

Figure 3:
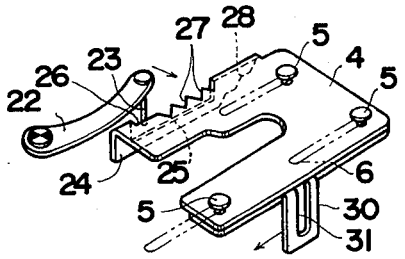
FIG. 3 is a perspective view of a sliding plate.

As shown in FIG. 3, one side of the sliding plate 4 is bent vertically and in the lower direction to form a flange 24, in the bent portion of which is provided a cut-away portion 25 through which is inserted the pin 23. The cut-away portion 25 is provided with a stepped portion 26 parallel to the longitudinal edge of the sliding plate 4 and plural recesses 27 recessed more inwardly than the stepped portion 26. The lower edge of the flange 24 of the sliding plate 4 is arranged to have stepped portions 28 which are successively varied in their height and to which is engaged an arm 29 of the piece 20 having the pin 18 secured thereto and being urged in the upper direction by the coil spring 19, as shown in FIG. 4. As apparent from FIG. 3, to the other edge of the sliding plate 4 is secured a projection 30 perpendicular to the plate 4 and into a slit 31 provided in the projection 30 is inserted, as shown in FIG. 2, a rod 33 projected eccentrically from a dial 32 which is rotatably attached to the outer wall of the frame 2. The dial 32 has a pointer 34.

Figure 1:
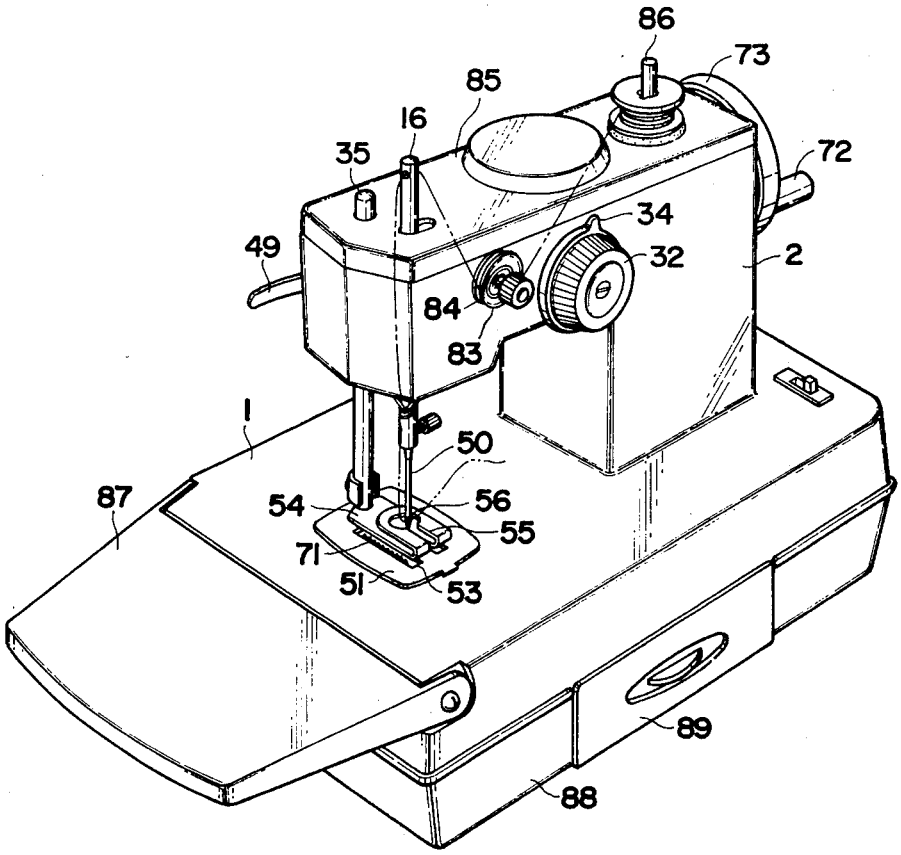
FIG. 1 is a perspective view of an embodiment of the present invention.

As shown in FIGS. 1 and 2, a support rod 35 for supporting a holding-down metal plate 54 is provided in the front end of the frame 2 so as to freely move in the upper and the lower directions, and to a frame piece 36 of fallen "U" shape pivotally supported by the support rod 35 is attached the needle holding rod 16 so as to freely move in the upper and the lower directions. A projection 39 projected from an attachment 38 secured to the portion of the needle holding rod 16 which is located within the fallen "U" of the frame piece 36 is freely slidably inserted in a guiding slit 40 provided in the vertical part of the frame piece 36, and into a horizontal slit 42 provided in a projection 41 which is bent vertically from the other end of the attachment 38 is inserted a crank pin 44 projected from an arm piece 43 of the rod 9 for rendering the needle operative. The needle holding rod 16 projected above the fallen "U" shaped frame piece 36 has the one end of the link 17 pivotally connected thereto, and the other end of the link 17 is pivotally connected to the one end of the "L" shaped lever 15. To the fallen "U" shaped frame piece 36 is secured an end of a torsion bar spring 45 which has the support rod 35 inserted therethrough while the other end of the torsion bar spring 45 is secured to the frame 2 so that the fallen "U" shaped frame piece 36 is urged in such a direction as shown by an arrow in FIG. 2 to draw the link 17 in the right direction.

The support rod 35 has the holding-down metal plate 54 secured to the lower end thereof and a stem 47 projected horizontally from the upper portion of the support rod 35 is urged in the downward direction by a coil spring 48 having the portion of the support rod 35 located within the fallen "U" of the frame piece 36 inserted therethrough, said stem 47 being projected outside through a slit provided in the side all of the frame 2 to engage with a pushing-up piece 49 pivotally attached to the outer wall of the frame 2.

To the lower end of the needle holding rod 16 is detachably attached a needle 50 whose lowermost end is positioned right above a needle hole 52 of a needle plate 51 press fitted in an opening of the table 1. The needle hole 52 is arranged to have a diameter large enough to permit the zig-zag movement of the needle to be attained. At the left and right sides of the needle hole 52 are provided slits 53 and 53 into and out of which come a pair of feed teeth. As shown in FIG. 2, a holding-down metal plate 54 secured to the lower end of the support rod 35 is positioned right above these slits 53 and 53, said holding-down metal plate 54 being formed to have a notch 55, through which a thread is inserted, and a needle hole 56 same as the needle hole 52.

As shown in FIGS. 4 and 6, a lower rod 57 associated with the upper rod 9 is horizontally and rotatably supported by supporting members projected from the underside of the table 1 and to one end of the lower rod 57 is secured a periphery cam 58 which is positioned below the needle 50. A rod 59 parallel to the lower rod 57 is rotatably and reciprocately supported by supporting members projected from the underside of the table 1 and to an end of the stem 59 is secured a holding piece 60, which is extended in the upper direction to form a hook 63 at the uppermost end thereof. From one side of the holding piece 60 is projected a pin 61 which is engaged with the periphery cam 58 and along the other side of the holding piece 60 is arranged another holding piece 62 of elastic material such as copper plate whose lower end is fixed onto the holding piece 60 in such a manner that a hook 90 formed at the uppermost end of the holding piece 62 comes to elastically contact with the hook 63 of the other holding piece 60. The needle 50 is arranged to have the lowermost end thereof located between these hooks 63 and 90.

In a ring-shaped channel 65 of a boss 64 secured to the horizontal rod 59 is fitted a pin 67 of an arm 66 extended from the vertical rod 14 of the "L" shaped lever 15. As shown in FIG. 6, to a pin 68 projected from a vertical plate extending from the underside of the table 1 is freely slidably engaged an end of a feed metal holding plate 69, the other end of which eccentrically supports the lower rod 57, and to this feed metal holding plate 69 is fixed an end of feed metal 70, the other end of which provided with a pair of feed teeth 71 is arranged to freely come in and out of the feed teeth slits 53 and 53, respectively.

There is projected outside the frame 2 one end of the upper rod 9, to which is secured a manually rotating disc 73 having a knob 72 at an eccentric position thereof. The upper rod 9 is arranged to interlock a rotating vertical shaft 76 through interlocking gears 74 and 75 and the shaft 76 is arranged to interlock the lower rod 57 through interlocking gears 77 and 78. There is provided adjacent to one side of the shaft 76 a motor 79 whose rotating shaft 80 can be interlocked with the shaft 76 through interlocking gears 81 and 82. The motor 79 is connected to a battery or through a rectifier to an AC power source.

As shown in FIG. 1, the dial 32 is rotatably mounted on the front side of the frame 2 and a regulating member 83 for regulating the tension of the thread is also attached through a coil spring 84 to the front side of the frame 2. The top side of the frame 2 is covered by a cover plate 85 from which is projected a stem 86 for holding a reel and the upper ends of the needle holding rod 16 and the support 35 are respectively projected through holes provided in the cover plate 85. To one side of the table 1 is attached an auxiliary plate 87 which can be freely folded to provide a plane in same lever as the table 1. The table 1 is mounted on a box 88 having a drawer 89 for containing accessories and a battery case.

There will be described the operation of the embodiment of the present invention.

The reel is attached onto the stem 86 and the thread is threaded to the needle 50 via the regulating member 83, as shown in FIG. 1.

Figure 7:
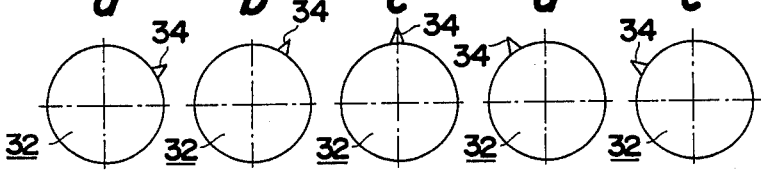
Figure 7:
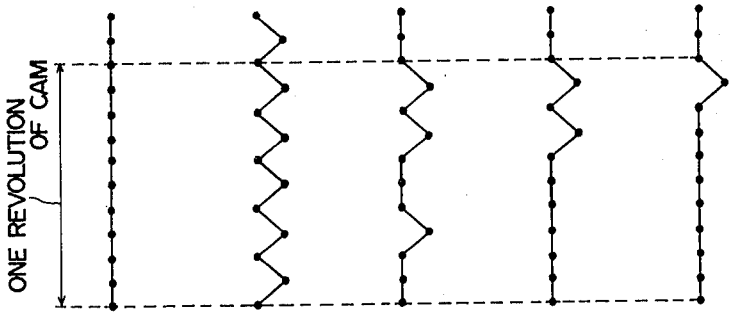
Figure 7:
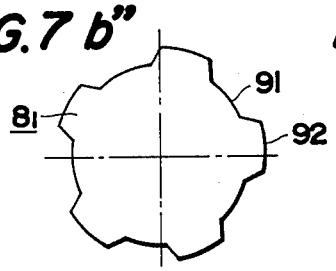
Figure 7:
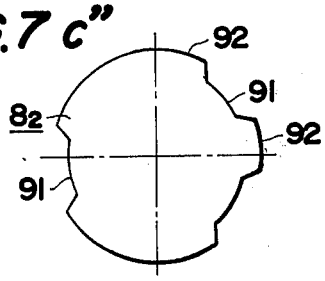
Figure 7:
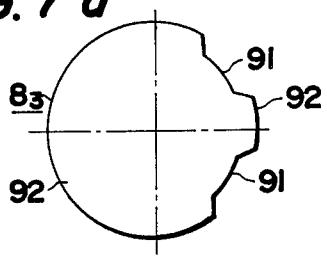
Figure 7:
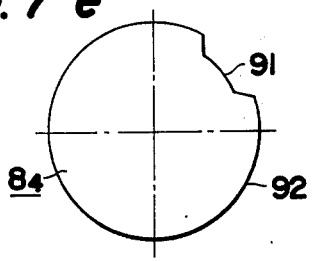

When it is desired to sew in straight line, the dial 32 is turned round clockwise to be stopped at a position at which the pointer 34 of the dial 32 is located as shown in FIG. 7*a*. At this time, the rod 33 of the dial engaged in the slit 31 of the projection 30 of the sliding plate 4 urges the sliding plate 4 in the rightward direction until the guiding pins 5 reach the right end of the slits 6, respectively, as shown in FIG. 2. As apparent from FIGS. 3, 4 and 5, the vertically movable pin 18 is engaged with the stepped portion 26 of the cut-away portion 25 of the sliding plate 4, and is kept disconnected from any of cams of the cam body 8. The piece 20 having the vertically movable pin 18 secured thereto is engaged via its arm 29 with the lower edge of the flange 24 of the sliding plate 4 so as to keep the vertically movable pin 18 in the lowest level against the action of the coil spring 19.

When, keeping the sewing machine in this state, the manually rotating disc 73 is manually rotated or the motor 79 is rendered operative, the upper and the lower rods 9 and 57 rotate in such a manner that the upper rod 9 causes the needle holding rod 16 to be moved up and down as shown in FIG. 2, that is, the threaded needle 50 to be moved up and down through the needle hole 52 and that the lower rod 57 causes the cam 58 to be rotated so as to rotate the holding piece 60 engaged with the cam 58 integrally with the elastic holding piece 62. Accordingly, the thread lowering with the needle 50 is caught between the rotated holding pieces 60 and 62 and drawn in a loop from a piece of cloth to be sewn. When the needle is then raised, the piece of cloth is fed by the feed metal 70. When the needle 50 is again lowered to the thread through the loop of the thread which is already made by the rotated holding pieces 60 and 62, the thread caught between the holding pieces is released and the thread newly guided through the loop is then caught between the holding pieces 60 and 62.

More particularly, when the needle 50 is lowered to enter between the hooks 63 and 90 of the holding pieces 60 and 62 and is further lowered through the hooks 63 and 90, the end of the thread which is drawn in "U" shape from the underside of the piece of cloth by means of the needle 50 is caught between the hooks 63 and 90. Then, the needle 50 begins to rise and at the same time the holding pieces 60 and 62 between which the thread is caught is swung in the forward direction. When the needle 50 begins to lower again, the feed metal 70 moves in the forward direction to feed the piece of cloth urging the feed teeth 71 in the upper direction and then moves in the backward direction allowing the feed teeth 71 to be lowered. At the same time the holding pieces 60 and 62 are swung back with the thread caught between them to locate their hooks 63 and 90 right below the needle 50. When the needle 50 is further lowered to pass the accompanying thread into the loop-shaped thread already caught between the hooks 63 and 90, the hooks 63 and 90 open to release the thread caught between them. When the needle 50 is furthermore lowered to come out between the hooks 63 and 90, the end of the thread which is drawn in "U" shape from the underside of the piece of cloth is caught between the hooks 63 and 90. This process is successively repeated to sew the piece of cloth in straight line with chain stitches of the thread on the underside of the piece of cloth.

As stated above, the vertical up-and-down movement of the needle 50 and the reciprocal movement of the holding pieces 60 and 62 and the feed metal 70 caused by the rotation of the upper and the lower rods 9 and 57 allow the piece of cloth to be sewn in straight line as shown in FIG. 7*a'*, sewing a stitch every rotation of the upper and the lower rods 9 and 57.

When the dial 32 is turned round counterclockwise to locate its pointer 34 to the position as shown in FIG. 7*b*, the sliding plate 4 slides slightly to the left, the pin 23 of the arm piece 22 engages with one of the recesses 27 adjacent to the stepped portion 26 of the cut-away portion 25 of the sliding plate 4 and moves to the inner end of the slit 21. As a result, the end of the "L" shaped lever 15 having the vertically movable pin 18 attached thereto and being urged by the torsion bar spring 45 slides inward in the slit 21 to engage the pin 18 with the lowest cam $8_1$. Following the slide of the sliding plate, the arm 29 of the piece 20 having the vertically movable pin 18 secured thereto and being engaged with the lower edge of the flange 24 comes nearer the stepped portion 28 of the lower edge. The lowest cam $8_1$ is formed to have a concave 91 and a convex 92, alternately, with a same interval at the periphery thereof. The vertically movable pin 18 is engaged with either of the concave 91 or the convex 92 every rotation of the upper rod 9 and slided in the front-and-backward directions in the slit 21 according to the concave and convex of the cam $8_1$, so that the "L" shaped lever 15 is moved in both directions as indicated by an arrow in FIG. 4 to move to the right and to the left the link 17 pivotally connected to the other end of the "L" shaped lever 15. Therefore, when the vertically movable pin 18 is engaged with the concave 91 of the cam $8_1$, the needle holding rod 16 is drawn against the action of the torsion bar spring 45 to the right in FIG. 2 while when the pin 18 with the convex 92 of the cam $8_1$, the rod 16 is drawn back by the action of the spring 45. This process is repeated. At the same time, the movement of the "L" shaped lever 15 is transmitted through the vertical rod 14, the arm 66 and the pin 67 to the lower rod 59, thus causing the lower rod 59 to perform same movement as that of the link 17 so that both of the needle 50 and the holding pieces 60 and 62 are synchronously moved to the right and to the left every stitch to thereby accomplish such zig-zag sewing as shown in FIG. 7*b'*. In this case ten stitches are attained every revolution of the cam $8_1$.

When the dial 32 is further turned round counterclockwise to locate the pointer 34 to the position as shown in FIG. 7*c*, the sliding plate 4 is slided to engage the pin 23 of the arm piece 22 with a next recess of the recesses 27 and then to engage the arm 29 of the piece 20 with the lowest step of the stepped portion 28 of the flange 24 so that the vertically movable pin 18 is raised by one step to engage with the cam $8_2$ mounted on the lowest cam $8_1$. The cam $8_2$ has such concaves 91 and convexes 92 as shown in FIG. 7*c''*. Therefore, when the vertically movable pin 18 is engaged with the concave 91, both of the needle 50 and the holding pieces 60 and 62 are drawn to the right to accomplish a zig-zag pattern of two stitches and then one stitch as shown in FIG. 7*c'*.

When the dial 32 is further turned round counterclockwise to locate its pointer 34 to the position as shown in FIG. 7*d*, the pin 23 of the arm piece 22 is engaged with a next recess of the recesses 27 and at the same time the vertically movable pin 18 is engaged with a higher step of the stepped portion 28 to be further raised to engage with the cam $8_3$ located on the cam $8_2$. The cam $8_3$ has such concaves 91 and convexes 92 as shown in FIG. 7*d''*. Therefore, when the vertically movable pin 18 is located in the concave 91, both of the needle 50 and the holding pieces 60 and 62 are drawn to the right to perform a zig-zag pattern of two stitches intermittently as shown in FIG. 7*d'*.

When the dial 32 is further turned round counterclockwise to locate its pointer 34 to the position as shown in FIG. 7*e*, the pin 23 of the arm piece 22 is engaged with the last recess of the recesses 27 and the arm 29 of the piece 20 is released from the stepped portion 28 to engage with the underside of the sliding plate 4 so that the vertically movable pin 18 is raised in the highest level to engage with the top cam $8_4$. This cam $8_4$ has such concave 91 and convex 92 as shown in FIG. 7*e''* to thereby allow an intermittent zig-zag pattern of one stitch to be attained as shown in FIG. 7*e'*.

What is claimed is:

1. A toy sewing machine comprising:

a rotary cam shaft associated with a rotary rod for moving a needle-holding rod having a needle thereon in the upper and lower directions;

a cam body comprising a plurality of overlapping cams having plural cam faces at the periphery thereof and supported by the cam shaft;

a vertically movable pin arranged to engage with any one of the cam faces of the cam body;

a rotary shaft;

a freely rotatable lever of "L" shape pivotally supported by the rotary shaft and urged in one direction by a torsion bar spring, one end of said lever having the pin penetrated therethrough;

a frame to which the base portion of said lever is pivotally attached;

a link pivotally attached to the other end of said lever and connected to a needle-holding rod;

thread-holding pieces for cooperation with said needle;

a thread-holding rod for controlling the thread holding operation of the thread-holding pieces; and an arm projected from the rotary shaft and connected to the thread-holding rod for controlling the thread holding operation of the thread-holding rod.

* * * * *